United States Patent [19]

Docking et al.

[11] Patent Number: 4,457,461

[45] Date of Patent: Jul. 3, 1984

[54] HEAD MOUNTING APPARATUS

[75] Inventors: Paul A. J. Docking, Clwyd, Wales; Michael H. Glynn, Basingstoke, England

[73] Assignee: Rilkington P.E. Limited, St. Helens, England

[21] Appl. No.: 421,413

[22] Filed: Sep. 22, 1982

[30] Foreign Application Priority Data

Sep. 24, 1981 [GB] United Kingdom ..... 8128905

[51] Int. Cl.[3] ..... A45C 1/04

[52] U.S. Cl. ..... 224/181; 2/6; 350/139; 350/143; 351/245

[58] Field of Search ..... 224/181; 2/6, 422, 15, 2/438, 451; 351/245; 350/139, 143

[56] References Cited

U.S. PATENT DOCUMENTS

| | | | |
|---|---|---|---|
| 874,179 | 12/1907 | Forth et al. | 351/245 |
| 2,270,931 | 1/1942 | Corcoran | 224/181 X |
| 2,990,765 | 7/1961 | Winzenburg | 330/139 |
| 3,040,741 | 6/1962 | Carolan | 128/207.11 X |
| 3,077,880 | 2/1963 | Morton, Jr. | 128/206.27 |
| 3,108,282 | 10/1963 | Rehman et al. | 2/6 |
| 3,833,935 | 9/1974 | Ansite et al. | 2/6 |
| 3,971,933 | 7/1976 | Adamson, Jr. | 250/213 VT |
| 4,270,679 | 6/1981 | Gildea et al. | 224/181 |

FOREIGN PATENT DOCUMENTS

| | | |
|---|---|---|
| 1560320 | 12/1977 | United Kingdom . |
| 1569088 | 3/1978 | United Kingdom . |

*Primary Examiner*—Steven M. Pollard
*Attorney, Agent, or Firm*—*F. Eugene Davis*

[57] ABSTRACT

Head mounting apparatus which can accommodate different head sizes and shapes comprises a substantially rigid member for supporting equipment, such as night vision equipment, to be used by the wearer, and a flexible member which can flex to adapt to the head of the wearer. The rigid and flexible members are connected by pivotal means at pivot positions along spaced pivotal axes. The flexible member has buttons for attachment of straps by which it is in use secured to the wearer's head. The position of the rigid member relative to the flexible member may be adjustable by manual rotation of knobs.

17 Claims, 4 Drawing Figures

HEAD MOUNTING APPARATUS

BACKGROUND OF THE INVENTION

This invention concerns improvements in or relating to head mounting apparatus, that is to say apparatus by which equipment, such as for example night vision equipment, can be mounted on the head of a person who is to use the equipment.

Head mounting of equipment can have the advantage over hand holding of leaving the user's hands free to perform other functions. Notably in the night vision field there is a requirement for the user to wear the viewing equipment on his head in similar fashion to goggles. It is obviously desirable that there should be as much comfort as possible for the wearer and this could in principle be achieved by tailoring the head mounting apparatus individually to the particular wearer's head size and shape. This is not a very practical approach, however, and there is a requirement for at least some degree of standardisation so that the same form of apparatus can be used by different individual wearers and can accommodate reasonable differences in head size and shape whilst retaining a high level of comfort.

SUMMARY OF THE INVENTION

According to the present invention there is provided head mounting apparatus comprising a substantially rigid member for supporting equipment to be used by a wearer, a flexible member which can flex to adapt to the head of the wearer, and pivotal means involving two spaced pivotal axes connecting the flexible member to the substantially rigid member.

The spaced pivotal axes may in use be substantially vertical axes (when the wearer's head is in the usual upright disposition with the face substantially vertical), and there may be two pivot positions along each axis. The pivotal means may comprise lugs projecting from the substantially rigid and flexible members and pivot pins located in the lugs.

The flexible member may have an upper portion which in use lies across the forehead of the wearer, and two side portions, preferably with inwardly curved ends, which bear against the cheeks, and the substantially rigid member may be of similar shape. The flexible member may comprise a flexible plate backed by a resilient padding, and may have means, such as projecting buttons, for attachment of straps by which it is in use secured to the head of the wearer.

Adjustment means may be provided for adjusting the position of the substantially rigid member relative to the flexible member. For example, there may be manually rotatable screw-threaded pivot pins which engage with screw-threaded elements, such as bushes, on one of the members.

The substantially rigid member may have a part e.g. a central upper part, adapted for attachment of a support element from which equipment, such as night vision equipment, to be used by the wearer can be suspended. Thus there may be cantilever member having a clip fastening at one end which clips on to the substantially rigid member so that the cantilever member projects forwardly therefrom. The cantilever member may have a button operated quick release mechanism for detaching the clip fastening from the substantially rigid member. There may be a slide from which the equipment can be suspended and which is movable along the cantilever member to adjust the position of the equipment relative to the substantially rigid member.

THE DRAWINGS

An embodiment of head mounting apparatus in accordance with the invention will now be described, by way of example, with reference to the accompanying drawings, in which.

DETAILED DESCRIPTION

Figure 1:
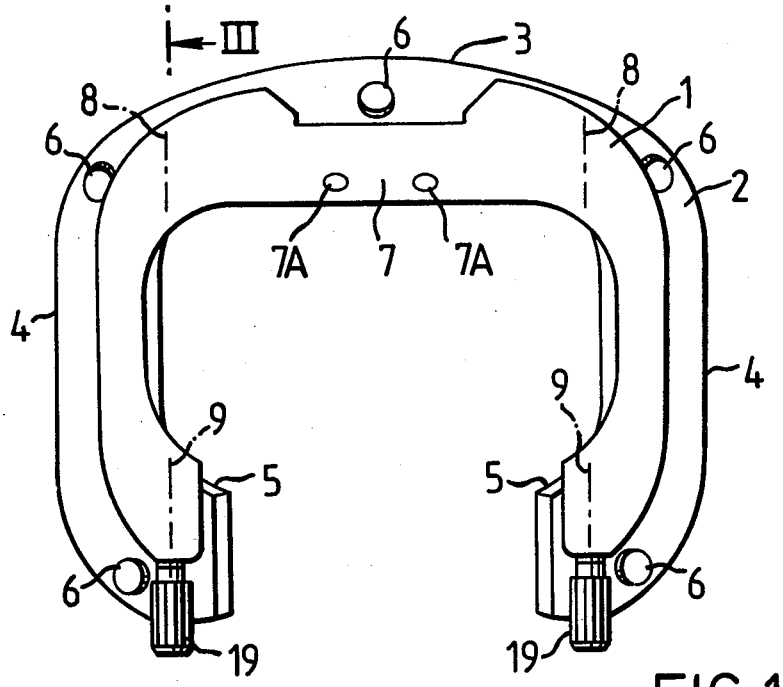
FIG. 1 is a front view.
Figure 2:
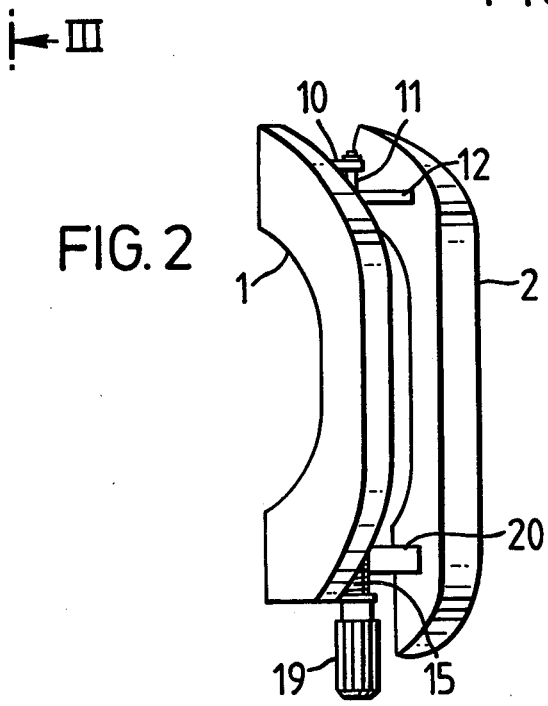
FIG. 2 is a side view.

FIGS. 1 and 2 respectively show front and side views of a substantially rigid member 1 behind which there is a flexible member 2. The flexible member 2 is adapted to engage against the face of a wearer of the apparatus and has an upper portion 3 which in use extends across the forehead and two downwardly depending portions 4 with inwardly curved ends 5 which engage round the cheeks. These portions partially surround an aperture through which the wearer can view, and the substantially rigid member 1 is of similar shape.

The flexible member 2 has forwardly projecting buttons 6 for the attachment of strap fittings by which the apparatus is secured to the head of the wearer. The upper portion of the substantially rigid member 1 has a central narrowed part 7 on to which a support element for night vision equipment can be clipped.

The substantially rigid member 1 and the flexible member 2 are connected together by pivotal connecting means at two upper and two lower positions, the upper position pivotal axes being indicated by reference 8 in FIG. 1 and the lower position pivotal axes by reference 9. Each upper axis 8 is aligned with the respective lower axis 9 so that the left hand pivots effectively have a common, in use vertical, axis and the right hand pivots effectively have a common, in use vertical, axis spaced from the left hand axis.

Figure 3:
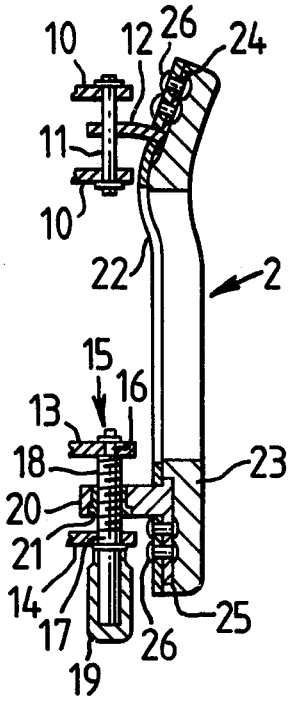
FIG. 3 is a sectional view on the line III—III of FIG. 1.

The pivotal connecting means is shown in the sectional view of FIG. 3 and parts are also visible in FIG. 2. At the upper pivot positions the rigid member 1 has rearwardly projecting spaced lugs 10 carrying a pivot pin 11, and the flexible member 2 has a forwardly projecting lug 12 having a hole in which the pivot pin 11 is located. At the lower pivot positions the rigid member 1 has rearwardly projecting spaced lugs 13 and 14 which carry a pivot pin 15 having a small diameter upper part 16 located in the upper lug 13 and a larger diameter lower part 17 located in the lower lug 14. The central part 18 of the pin 15 is of similar diameter to the lower part 17 and has an external screw thread. The pin 15 has a knob 19 by which it can be manually rotated. The flexible member 2 has a forwardly projecting lug 20 in which is mounted a bush 21 having an internal screw thread which engages with the external thread on the pin 15. Hence by rotation of the pin 15 the lug 20, and hence the flexible member 2, can be moved up or down relative to the rigid member 1, the lug 12 sliding along the upper pivot pin 11 during such relative movement. The relative vertical positions of the members 1 and 2 can therefore readily be adjusted by manually rotating the knobs 19.

It can be seen from FIG. 3 that the flexible member 2 comprises a relatively thin flexible plate 22, e.g. of suitable metal or plastics material, backed with a layer of resilient soft padding 23 secured to the plate 22. The forwardly projecting lugs 12 and 20 extend through slots in the plate 22 and have respective base flanges 24 and 25 secured by rivets 26 to the plate 22.

The substantially rigid member 1 may be of suitable metal or plastics material of sufficient rigidity to support the equipment to be carried by it. The rearwardly projecting lugs 10, 13, and 14 can be formed integrally therewith or secured thereto in any convenient manner, e.g. by welding.

The described pivotal connection arrangement between the members 1 and 2 enables the substantially rigid member 1 to retain a substantially rigid configuration while the flexible member 2 can adapt its configuration to the head, and specifically the face, of the particular wearer. The flexible plate 22 can flex to suit the general shape and size of the wearer's face and the padding layer 23 can adapt to the local face contours, thereby providing a high degree of comfort.

Figure 4:
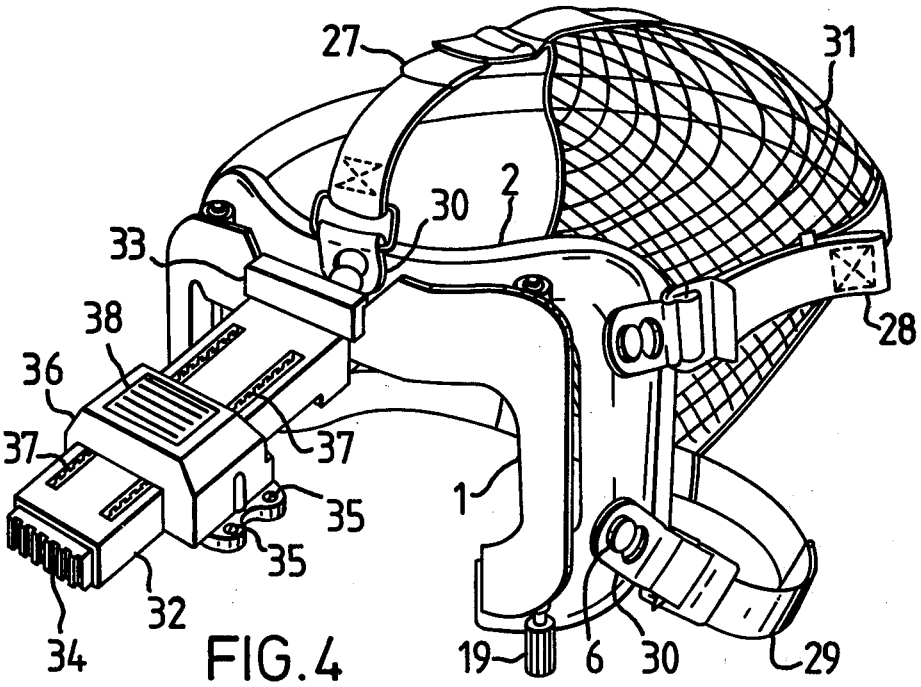
FIG. 4 is a perspective view showing further parts associated with the apparatus of FIGS. 1, 2 and 3 in use.

The flexible member 2 is in use secured to the wearer's head by an arrangement of straps. FIG. 4 shows such straps 27, 28 and 29 having fasteners 30 which engage with the buttons 6. The straps are adjustable in length (in a known manner) and have an associated skull cap 31. The top strap 27 goes over the top of the wearer's head, the middle strap 28 round the back of the head, and the bottom strap 29 round the back of the neck.

FIG. 4 also shows a support element clipped on to the rigid member 1 for supporting night vision equipment (not shown) to be used by the wearer. The support element comprises a cantilever member 32 having at one end a spring loaded clip fastening 33 which attaches to the narrow part 7 (FIG. 1) of the rigid member 1 and has associated projecting stubs (not visible) which register in locating holes 7A in the part 7. The cantilever member 32 projects forwardly from the rigid member 1 and at its other end is a button 34 which is connected with the clip fastening 33 by rods (not visible) passing along the inside of the cantilever member 32. By depressing the button 34 the clip fastening 33 can be released from the rigid member 1 permitting quick detachment of the night vision equipment when required. The night vision equipment is secured by screws 35 to a slide 36 mounted on the cantilever member 32. The slide 36 incorporates a spring loaded mechanism (not visible) which engages with toothed rails 37 extending along the cantilever member 32 whereby the slide can be held at a desired position along that member. The slide 36 has a button 38 which can be depressed to effect disengagement from the teeth of the rails 37 so that its position along the cantilever member 32 can be adjusted. The position of the night vision equipment suspended from the slide 36 can therefore be adjusted towards and away from the wearer. Further, the vertical position of the night vision equipment can be adjusted by rotation of the knobs 19 to raise or lower the rigid member 1 relative to the flexible member 2 as previously described. Since in use the flexible member 2 is securely strapped to the wearer's head, vertical movement of the rigid member 1 relative to the flexible member 2 causes vertical movement of the night vision equipment (suspended from the cantilever support clipped to the rigid member 1) relative to the wearer's eyes. The wearer can thus adjust the position of the night vision equipment towards and away from, and up and down relatively to, his eyes to achieve comfortable viewing.

The support element comprising the cantilever member 32 and slide 36 can conveniently be made mainly from plastics material in order to provide a relatively light weight arrangement. It will be appreciated, however, that this support element needs to have sufficient strength and rigidity to support the night vision equipment suspended from it.

The manner of use of the apparatus will be largely apparent from the foregoing. The straps 27,28,29 attached to the flexible member 2 are, after loosening if necessary, slipped over the wearer's head and then tightened to achieve a comfortable fitting of the flexible member against the face with the upper part 3 bearing against and across the forehead and the side parts 4 and their ends 5 bearing against the cheeks. During such tightening the flexible member flexes to adapt to the individual wearer's particular face shape and size. The substantially rigid member 1, which is supported by the flexible member 2 thorugh the described pivotal connections, retains its required rigid configuration while the flexible member flexes, the spaced pivot axes (which are substantially vertical when the head is in its normal upright position with the face substantially vertical) permitting relative movement as between the members 1 and 2. After such securing to the wearer's head the cantilever member 32 (with the night vision equipment already attached to its slide 36) is clipped on to the upper central part 7 of the substantially rigid member 1. The wearer can then adjust the position of the night vision equipment vertically, by movement of the rigid member 1 relative to the flexible member 2 through use of the knobs 19 as previously described, and towards and away from his face by adjusting the position of the slide 36 along the cantilever member 32 relative to the rigid member 1 by use of the button 38. The night vision equipment (which may itself incorporate provision for adjusting the inter-ocular spacing of the two viewing channels to suit the individual wearer's particular eye separation) is then comfortably secured to the wearer's head in the manner of goggles, and can be rapidly detached if required by use of the quick release button 34.

If desired a weight may be carried at the back of the wearer's head to counterbalance the weight of the equipment at the front. Such counterbalance may be suspended from the straps and skull cap arrangement, for example by means of suitable hooks, and may conveniently comprise the power supply, i.e. battery, for the night vision equipment.

It will be appreciated that the specific embodiment shown and described is given by way of illustration and example and that various modifications could be made thereto without departing from the scope of the invention. For example, the flexible plate 22 with its projecting lugs 12 and 20 could be a single unitary member produced for example by moulding, i.e. the parts 12, 20 24 and 25 in FIG. 3 could in practice be moulded as an integral part of the plate 22. Further, the padding 23 need not be permanently fixed to the plate 22 but could be detachably secured, for example by means of wrap-round tabs, so as to permit ready replacement. The facility for vertical adjustment of the rigid member 1 relative to the flexible member 2 may be omitted if not required.

We claim:

1. Head mounting apparatus comprising a substantially rigid member for supporting equipment to be used by a wearer, a flexible member which can flex to adapt to the head of the wearer, and pivotal means involving two spaced substantially parallel pivotal axes each directly connecting the flexible member to the substantially rigid member.

2. Apparatus according to claim 1 in which the two spaced pivotal axes are, in use, substantially vertical axes (when the wearer's head is in the usual upright disposition with the face substantially vertical).

3. Apparatus according to claim 1 or claim 2 having two pivot positions along each axis.

4. Apparatus according to claim 1 or claim 2 in which the pivotal means comprise lugs projecting from the substantially rigid and flexible members and pivot pins located in the lugs.

5. Apparatus according to claim 1 or claim 2 in which the flexible member has an upper portion which in use lies across the forehead of the wearer, and two side portions which bear against the cheeks.

6. Apparatus according to claim 5 in which the side portions have inwardly curved ends.

7. Apparatus according to claim 1 or claim 2 in which the substantially rigid member is of similar shape to the flexible member.

8. Apparatus according to claim 1 or claim 2 in which the flexible member comprises a flexible plate backed by a resilient padding.

9. Apparatus according to claim 1 or claim 2 in which the flexible member has means for attachment of straps by which it is in use secured to the head of the wearer.

10. Apparatus according to claim 1 or claim 2 comprising adjustment means for adjusting the position of the substantially rigid member relative to the flexible member.

11. Apparatus according to claim 10 comprising manually rotatable screw-threaded pivot pins which engage with screw-threaded elements on one of the members.

12. Apparatus according to claim 1 or claim 2 in which the substantially rigid member has a part adapted for attachment of a support element from which equipment to be used by the wearer can be suspended.

13. Apparatus according to claim 12 in which said part of the substantially rigid member is a central upper part.

14. Apparatus according to claim 12 comprising a cantilever member having a clip fastening at one end which clips on to the substantially rigid member so that the cantilever member projects forwardly therefrom.

15. Apparatus according to claim 14 in which the cantilever member has a button operated quick release mechanism for detaching the clip fastening from the substantially rigid member.

16. Apparatus according to claim 14 comprising a slide from which the equipment can be suspended and which is movable along the cantilever member to adjust the position of the equipment relative to the substantially rigid member.

17. Apparatus according to claim 1 or claim 2 in which the equipment to be used by the wearer is night vision equipment.

* * * * *